US011879193B2

(12) United States Patent
Ugnon-Coussioz et al.

(10) Patent No.: US 11,879,193 B2
(45) Date of Patent: Jan. 23, 2024

(54) APPARATUS AND METHOD FOR BONDING LAYERS COMPRISING FIBERS TO FORM A NON-WOVEN WEB

(71) Applicant: ANDRITZ KUESTERS GMBH, Krefeld (DE)

(72) Inventors: Jean-Michel Ugnon-Coussioz, Barraux (FR); Dennis Latendorf, Krefeld (DE)

(73) Assignee: ANDRITZ KUESTERS GMBH, Krefeld (DE)

( * ) Notice: Subject to any disclaimer, the term of this patent is extended or adjusted under 35 U.S.C. 154(b) by 21 days.

(21) Appl. No.: 17/702,815

(22) Filed: Mar. 24, 2022

(65) Prior Publication Data

US 2022/0307177 A1 Sep. 29, 2022

(30) Foreign Application Priority Data

Mar. 29, 2021 (DE) ..... 10 2021 107 901.2

(51) Int. Cl.

| | |
|---|---|
| ***D04H 5/03*** | (2012.01) |
| ***D04H 5/08*** | (2012.01) |
| ***D04H 1/498*** | (2012.01) |
| ***D04H 1/49*** | (2012.01) |

(52) U.S. Cl.

CPC ..... *D04H 5/03* (2013.01); *D04H 1/49* (2013.01); *D04H 1/498* (2013.01); *D04H 5/08* (2013.01)

(58) Field of Classification Search

CPC ..... D04H 5/03; D04H 1/492; D04H 1/498; D04H 5/08; D04H 1/49; D04H 1/465; D04H 18/04; D04H 3/11; D04H 1/495; D04H 1/732; D04H 1/74; D04H 5/00

See application file for complete search history.

(56) References Cited

U.S. PATENT DOCUMENTS

| | | | | |
|---|---|---|---|---|
| 7,278,187 | B2 * | 10/2007 | Petersen | D04H 1/593 19/302 |
| 10,718,076 | B2 * | 7/2020 | Weigert | D04H 1/498 |
| 2001/0027594 | A1 * | 10/2001 | Fleissner | D04H 18/04 28/107 |
| 2002/0157766 | A1 | 10/2002 | Vuillaume et al. | |

(Continued)

FOREIGN PATENT DOCUMENTS

| | | | |
|---|---|---|---|
| CN | 1780955 | A | 5/2006 |
| CN | 102369317 | A | 3/2012 |

(Continued)

*Primary Examiner* — Amy Vanatta

(74) *Attorney, Agent, or Firm* — Norman B. Thot

(57) ABSTRACT

An apparatus for bonding a first layer having short fibers with a second layer having long fibers into a non-woven web. The apparatus includes a first circulating belt on which the second layer is depositable and displacable, a second circulating belt via which the first layer is transferable at a transition point to the second layer, a pre-bonding unit arranged directly behind the transition point, and a bonding device. The pre-bonding unit has compactors which are spaced apart from one another. The compactors act in one region on the first or second circulating belt. The bonding device is arranged between the compactors and bonds together the first and second layers. The compactors and the bonding device are integrated into the apparatus to together be in an operating state when the first layer is transferred using the second circulating belt.

15 Claims, 7 Drawing Sheets

(56) References Cited

U.S. PATENT DOCUMENTS

| | | | | |
|---|---|---|---|---|
| 2002/0168910 | A1* | 11/2002 | Vuillaume | D04H 3/153 442/385 |
| 2003/0217448 | A1* | 11/2003 | Andersen | D04H 1/732 28/104 |
| 2005/0091811 | A1* | 5/2005 | Billgren | D04H 5/02 28/104 |
| 2006/0230589 | A1* | 10/2006 | Christensen | D04H 1/492 28/117 |
| 2007/0000107 | A1 | 1/2007 | Jeambar | |
| 2011/0277284 | A1 | 11/2011 | Muenstermann | |
| 2012/0096694 | A1* | 4/2012 | Muenstermainn | D04H 1/46 28/104 |
| 2018/0112339 | A1 | 4/2018 | Weigert et al. | |
| 2019/0226133 | A1 | 7/2019 | Venema et al. | |

FOREIGN PATENT DOCUMENTS

| | | | | |
|---|---|---|---|---|
| CN | 102388173 | A | 3/2012 | |
| CN | 10743862 | A | 12/2017 | |
| CN | 107532352 | A | 1/2018 | |
| CN | 109642375 | A | 4/2019 | |
| DE | 10 2008 008 549 | A1 | 9/2008 | |
| DE | 102008031278 | A1 * | 1/2009 | D04H 1/46 |
| DE | 10 2009 017 729 | A1 | 10/2010 | |
| DE | 10 2013 107 237 | A1 | 1/2015 | |
| DE | 102015106490 | B3 * | 9/2016 | D04H 1/495 |
| EP | 3 283 679 | B1 | 11/2020 | |
| JP | 2018-1714 | A | 1/2018 | |
| WO | WO 2004/063451 | A1 | 7/2004 | |
| WO | WO 2005/118934 | A1 | 12/2005 | |
| WO | WO 2008/110134 | A1 | 9/2008 | |
| WO | WO-2009112015 | A1 * | 9/2009 | D04H 1/48 |

* cited by examiner

APPARATUS AND METHOD FOR BONDING LAYERS COMPRISING FIBERS TO FORM A NON-WOVEN WEB

CROSS REFERENCE TO PRIOR APPLICATIONS

Priority is claimed to German Patent Application No. DE 10 2021 107 901.2, filed Mar. 29, 2021. The entire disclosure of said application is incorporated by reference herein.

FIELD

The present invention relates to an apparatus for bonding a layer comprising short fibers with a layer comprising long fibers to form a non-woven web, the apparatus having a first circulating belt on which the layer comprising long fibers can be deposited and displaced in a direction of production, and a second circulating belt via which the layer comprising short fibers can be transferred at a transfer point to the layer comprising long fibers. The present invention also relates to a method for producing a non-woven web which has a layer comprising short fibers and a layer comprising long fibers.

BACKGROUND

Such a device and such a method have previously been described in EP 3 283 679 B1. Due to the effect of a deflection roller, the two layers are pre-compacted at the transfer point before they reach a region between the first and the second belt in the direction of production, in which the two belts are at a distance that is greater than the sum of the thicknesses of the two layers. There is therefore no compaction in this region.

It has been shown in practice that when producing a non-woven web comprising two layers, one of which comprises short fibers with an average fiber length of regularly less than 1 mm to a maximum of 10 mm, and long fibers with a length of regularly between 10 mm and 150 mm, that production results are not always reproducible.

SUMMARY

An aspect of the present invention is therefore to provide an apparatus and a method via which the reproducibility of the production result is improved. The apparatus and the method should be in particular suitable for producing a non-woven web in which a layer comprising light short fibers, e.g., having a weight per unit area of between 10 and 50 grams per square meter, e.g., a light and wet wood fiber layer, is applied to a layer comprising long fibers, which can have a weight per unit area of between 15 and 50 grams per square meter and bonded therewith. This production regularly causes difficulties since carded layers comprising long fibers often have elastic properties and show recovery effects after compaction which can result in deformations, defects and even cracks in the wood fiber layer. The non-woven web produced can, for example, have a weight per unit area of between 20 and 150, for example, between 40 and 70, grams per square meter.

In an embodiment, the present invention provides an apparatus for bonding a first layer comprising short fibers with a second layer comprising long fibers to form a non-woven web. The apparatus includes a first circulating belt on which the second layer comprising the long fibers is depositable and displacable in a direction of production, a second circulating belt via which the first layer comprising the short fibers is transferable at a transition point to the second layer comprising the long fibers, a pre-bonding unit which is arranged directly behind the transition point in the direction of production, and a bonding device. The pre-bonding unit comprises a first compactor and a second compactor which are arranged spaced apart from one another in the direction of production. The first compactor and the second compactor are each configured to act in one region on the first circulating belt or in one region of the second circulating belt. The bonding device is arranged between the first compactor and the second compactor in the direction of production. The bonding device is configured to bond together the first layer with the second layer by twirling the long fibers and the short fibers. The first compactor, the second compactor and the bonding device are integrated into the apparatus so as to always be in an operating state together when the first layer comprising the short fibers is transferred using the second circulating belt.

BRIEF DESCRIPTION OF THE DRAWINGS

The present invention is described in greater detail below on the basis of embodiments and of the drawings in which.

DETAILED DESCRIPTION

Figures 1, 1A:
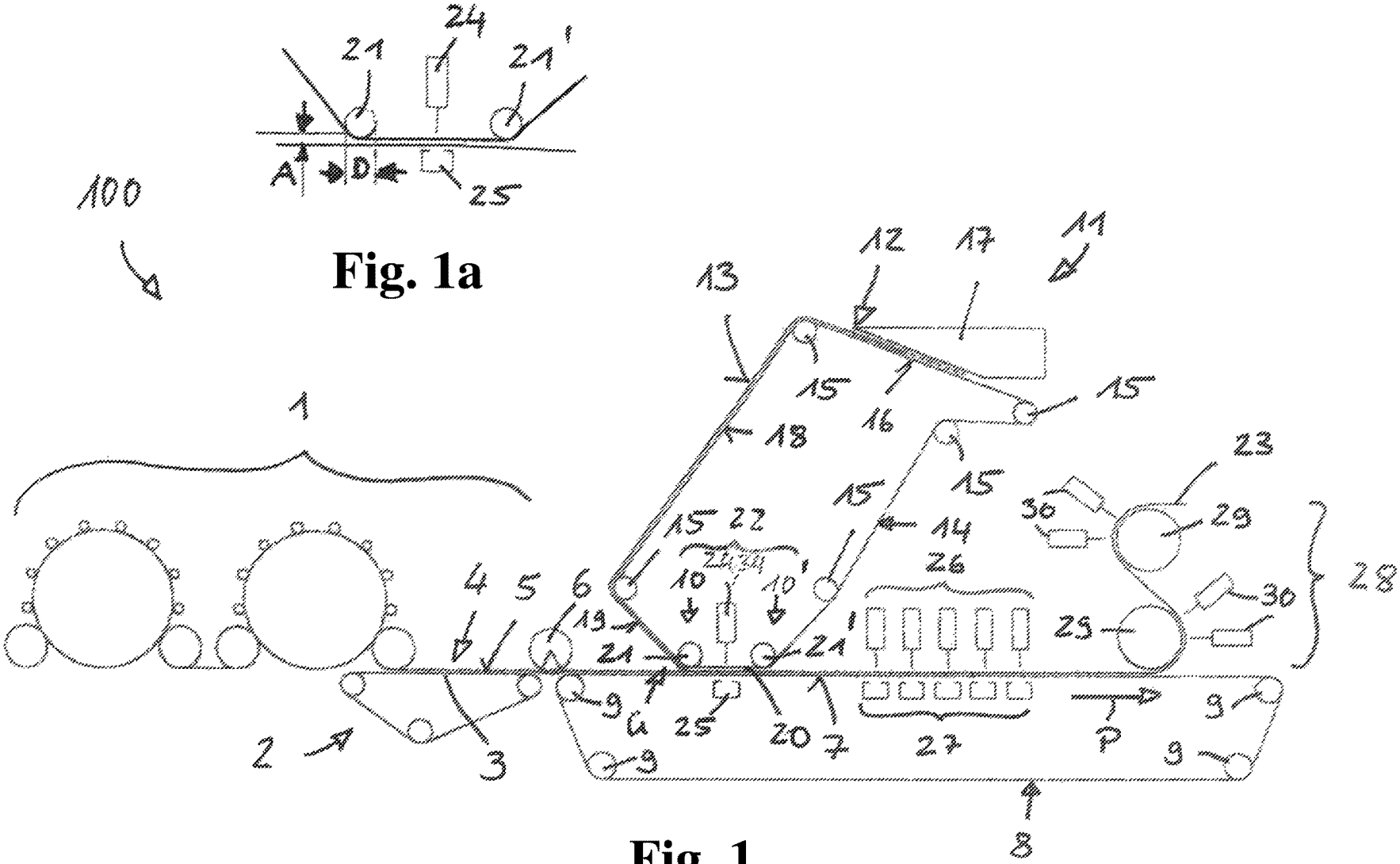
FIG. 1 is a first embodiment of the apparatus according to the present invention.
FIG. 1*a* shows a detail of FIG. 1.

The apparatus according to the present invention comprises a pre-bonding unit which is arranged directly behind the transfer point in the direction of production. "Directly behind" is to be understood as meaning that between the transfer point and the pre-bonding unit there are no further devices that bring about compaction and/or bonding of the two layers. The term "pre-bonding unit" is intended to make it clear that the components that belong to it are functionally inseparable.

The pre-bonding unit has two compactors that are spaced apart from one another in the direction of production. With these two compactors, a distance between the second belt and the first belt, which can, for example, run parallel thereto, can be reduced in one region to a value that is smaller than the sum of the thicknesses of the two layers, whereby the two layers can be compacted due to a compressive force acting on them over an area in the region. The two belts can also contact each other in this region, in other words, the distance can assume the value zero if no layer passes the pre-bonding unit. When passing through one or more layers, the belts can again assume a distance in this region simply because of the flexibility of at least one of the belts, without a displacement of the pre-bonding unit being absolutely necessary for this purpose.

The two compactors can either both act on one and the same of the first and second belts. Alternatively, one of the two compactors can act on one belt and the other of the two compactors can act on the other belt.

The pre-bonding unit also comprises a bonding device which is arranged between the compactors, in particular a water-jet compactor, via which the two layers can be bonded by twirling the fibers together. The bonding device can, for example, be designed so that the twirling of the fibers is not achieved over the entire area in which the compaction also takes place, but only in a partial region, in particular linearly via a nozzle bar extending transversely to the direction of production.

The compactor and the bonding device are also integrated into the apparatus according to the present invention so that they are always in the operating state together when the layer comprising short fibers is transferred by the second circulating belt.

Due to the arrangement of the bonding device between the compactors and the associated simultaneous bonding with the compaction, recovery of the layer comprising long fibers is avoided, so that the use of the apparatus according to the present invention or the application of the method according to the present invention substantially reduces the risk of defectively formed non-woven webs having two layers.

A first embodiment of an apparatus according to the present invention comprises a pre-bonding unit in which the compactors each comprise a pressure roller.

It has been shown, however, that the production costs of an apparatus according to the present invention can be reduced without restricting its functionality if, as in a second embodiment, the compactors of the pre-bonding unit each include a pressure bar.

The compactors of the pre-bonding unit can be arranged so that in the operating state, they bear against the first belt and, for example, move it parallel to the second belt in the region in which the pre-bonding unit acts.

In an embodiment of the apparatus according to the present invention, the pre-bonding unit can, for example, be designed so that the compactors bear against the second belt and, for example, move it parallel to the first belt. The compactors are therefore arranged inside the second circulating belt.

If the first compactor in the direction of production is a pressure roller, the guidance of the second belt can, for example, be selected so that the distance between the line extending transversely to the direction of production, along which the second belt first touches the outer circumference of the pressure roller, up to the upper side of the first belt, corresponds at least to the thickness of the fiber layers. This distance is typically 15 mm, 20 mm or more. An undesirable compacting of the layers before the transfer point is avoided due to this configuration.

In an embodiment of the present invention, when viewed in the direction of production, lower rollers circulated by the second belt can, for example, be arranged in front of the pre-bonding unit and/or, when viewed in the direction of production, behind the pre-bonding unit. An improvement in the guidance of the second belt is thereby achieved which can improve the pre-bonding process that can be achieved with the apparatus according to the present invention.

In an embodiment of the present invention, the lower rollers can, for example, be arranged so that the second belt has an inlet angle $\alpha$ of between 1° and 10° and an outlet angle $\alpha'$ of greater than 1° relative to the first belt between the lower rollers and the compactors adjacent to them. It has been shown that a particularly good result can be achieved with the pre-bonding unit with an inlet angle $\alpha$ in this size range, while the size of the outlet angle $\alpha'$ is only of minor importance for the result.

In an embodiment of the present invention, the first compactor can, for example, act from above against the lower run of the second circulating belt when viewed in the direction of production, and the second compactor, when viewed in the direction of production, can, for example, act from below against the upper run of the first circulating belt so that the first circulating belt undergoes a change of direction when passing the second compactor. It has surprisingly been shown that this reduces the undesired tendency for the pre-bonded layers to adhere to the second circulating belt. The change in direction can, for example, be at least 1°.

In an embodiment of the present invention, the first compactor can, for example, comprise a first lower pressure roller.

In an embodiment of the present invention, the second compactor can, for example, comprise a suction chamber to which a negative pressure can be applied. The tendency of the pre-bonded layers to stick to the second circulating belt can then again be substantially reduced.

The suction chamber can, for example, comprise at least one contact surface for the first circulating belt, and furthermore, for example, an intake port.

In an embodiment of the present invention, the second compactor can, for example, comprise a pressure roller which can be designed in an identical manner to the first lower pressure roller.

A suction chamber can in this case, for example, be provided in the direction of production, for example, directly behind the pressure roller. The pressure roller can alternatively be designed as a suction roller via which an air flow can be generated through the first circulating belt.

The water-jet compactor can, for example, be designed as a nozzle bar which emits jets of water with diameters of typically between 80 and 180 microns. The water bar is connected to a pressure source therefor, via which water can be supplied under a pressure that can be up to 100 bar, but is usually significantly lower, for example, is a maximum of 30 bar or lower, depending on the requirements influenced by properties of the short and long fibers for pre-bonding.

The nozzle bar can, for example, be arranged inside the second belt, for example, together with the two compactors, and can, for example, be at the same distance therefrom as seen in the direction of production.

In the method according to the present invention for producing a non-woven web, the layer comprising short fibers is applied to the layer comprising long fibers and the two layers are then compacted by mechanical pressure acting over a longitudinal region of the two layers. The two layers are also bonded together by water jets, which in part act in this length range. It has been shown that a particularly effective pre-bonding of the two layers is thereby achieved without any detachment, in particular, of short fibers, to an undesired extent.

The water jets can, for example, be directed onto the layer comprising short fibers. It has been shown that the pre-bonding is particularly effective thereby and that at the same time, the water can easily be collected under the effect of a negative pressure via a suction box and returned to the process.

The present invention is further clarified below under reference to the purely schematic drawings.

The first embodiment of the apparatus according to the present invention (apparatus 100), denoted as a whole by 100 in FIG. 1, comprises a carding unit 1 with which a layer of long fibers 4 can be produced. It comprises a circulating deposit belt 2 having an upper run 3 on which the long fibers 4 can be deposited in the form of a layer 5 comprising the long fibers 4.

The apparatus 100 also includes a suction roller 6 with which the layer 5 can be transferred to an upper run 7 of a first circulating belt 8 circulating around rollers 9 in a clockwise direction. The upper run 7 moves in the direction of the arrow drawn in FIG. 1, which thus symbolizes the direction of production P.

The first circulating belt 8 is designed to be permeable to liquids and gases, for example, as a screen belt.

The apparatus 100 also includes a device 11 for providing a layer 13 comprising short fibers 12. For this purpose, the device 11 comprises a second circulating belt 14 which circulates counterclockwise around rollers 15.

The second circulating belt 14 is in turn designed to be permeable to liquids and gases, for example, as a screen belt. Due to the arrangement of the rollers 15, a region 16 is formed that ascends, as viewed in the direction of rotation, and in which the short fibers 12 are deposited from a headbox 17, for example, as an aqueous emulsion, to form the layer 13.

The layer 13 comprising short fibers 12 reaches a lower run 20 of the second circulating belt 14 via regions 18, 19 which slope downward in relation to the direction of circulation. The lower run 20 is formed between two lower rollers 21.

In the apparatus 100, the lower rollers 21 form compactors 10, 10' and are part of a pre-bonding unit 22. They are, when the apparatus 100 is in operation, relative to the upper run 7 of the first circulating belt 8, in a position in which the distance between the lower run 20 of the second circulating belt 14 and the upper run 7 of the first circulating belt 8 is smaller than the sum of the thicknesses of layers 5 and 13.

As illustrated in FIG. 1*a*, at least the first lower roller 21 in the direction of production has a diameter D. It is greater than or equal to one twentieth of the length of the pressure roller transverse to the direction of production P. The guidance of the second circulating belt 14 is selected so that the line extending transversely to the direction of production P along which the second circulating belt 14 first touches the outer circumference of the lower roller 21 has a distance A which corresponds at least to the sum of the thicknesses of the layers 13 and 5.

The layer 13 is transferred to the layer 5 due to the arrangement of the rollers 15 and the lower rollers 21 at a transfer point Ü, which is seen in the direction of production P in front of the lower roller 21 shown on the left in the drawing. Since the distance between the upper run 7 and the lower run 20 is smaller than the sum of the thicknesses of the two layers 5 and 13, the two layers 5 and 13 experience a first areal compaction on the way to formation of a non-woven web 23 when they pass the area between the two lower rollers 21. The size of the area depends on the distance between the two lower rollers 21 in the direction of production P.

So that the desired compaction can take place, the first and second circulating belts 8, 14 must rotate at identical speeds so that there is no friction during compaction, which could adversely affect the compaction process.

So that the two layers 5, 13 have sufficient strength after leaving the region between the upper run 7 and the lower run 20 for further processing steps to form the non-woven-web 23, the pre-bonding unit 22 includes a nozzle bar 24 arranged in the direction of production P between the two lower rollers 21 and within the second circulating belt 14, which nozzle bar 24 forms a bonding device 34, and a collecting device 25, which is arranged at a corresponding point in the direction of production P and is arranged within the first circulating belt 8, and which can be a suction box subjected to negative pressure. On its side facing the lower run 20, the nozzle bar 24 comprises a plurality of nozzles from which jets of water are emitted under pressure during operation of the apparatus 100 so as to bond the two layers 5 and 13 through the lower run 20 of the second circulating belt 14 by twirling the fibers. The collecting device 25 is used to collect at least part of the water discharged from the nozzle bar 24, which can then be returned to the production process, possibly after treatment.

For further bonding and compaction, a plurality of nozzle bars 26 and collecting devices 27 are provided outside of the second circulating belt 14 in order to additionally bond the layers 5 and 13 from above.

A further bonding device 28 is provided downstream in the direction of production P. It comprises two bonding drums 29 which are circulated by the layers 5 and 13 during operation so that each of the two layers 5 and 13 is in contact with one of the two bonding drums 29 over an angular range of approximately 120°. Two additional nozzle beams 30 are provided for each bonding drum 29 and act in a region in which the layers 5, 13 are in contact with the bonding drum 29.

The bonding drums 29 each have a gas- and liquid-permeable lateral surface, so that at least part of the water discharged from the nozzle beam 30 during operation can be sucked off by the bonding drums and also, possibly after treatment, can be returned to the production process. The bonding device 28 is used for the further bonding of the two layers 5 and 13 to form the non-woven web 23 which, after passing through the bonding device 28, can be fed to further processing steps not described here.

Figure 2:
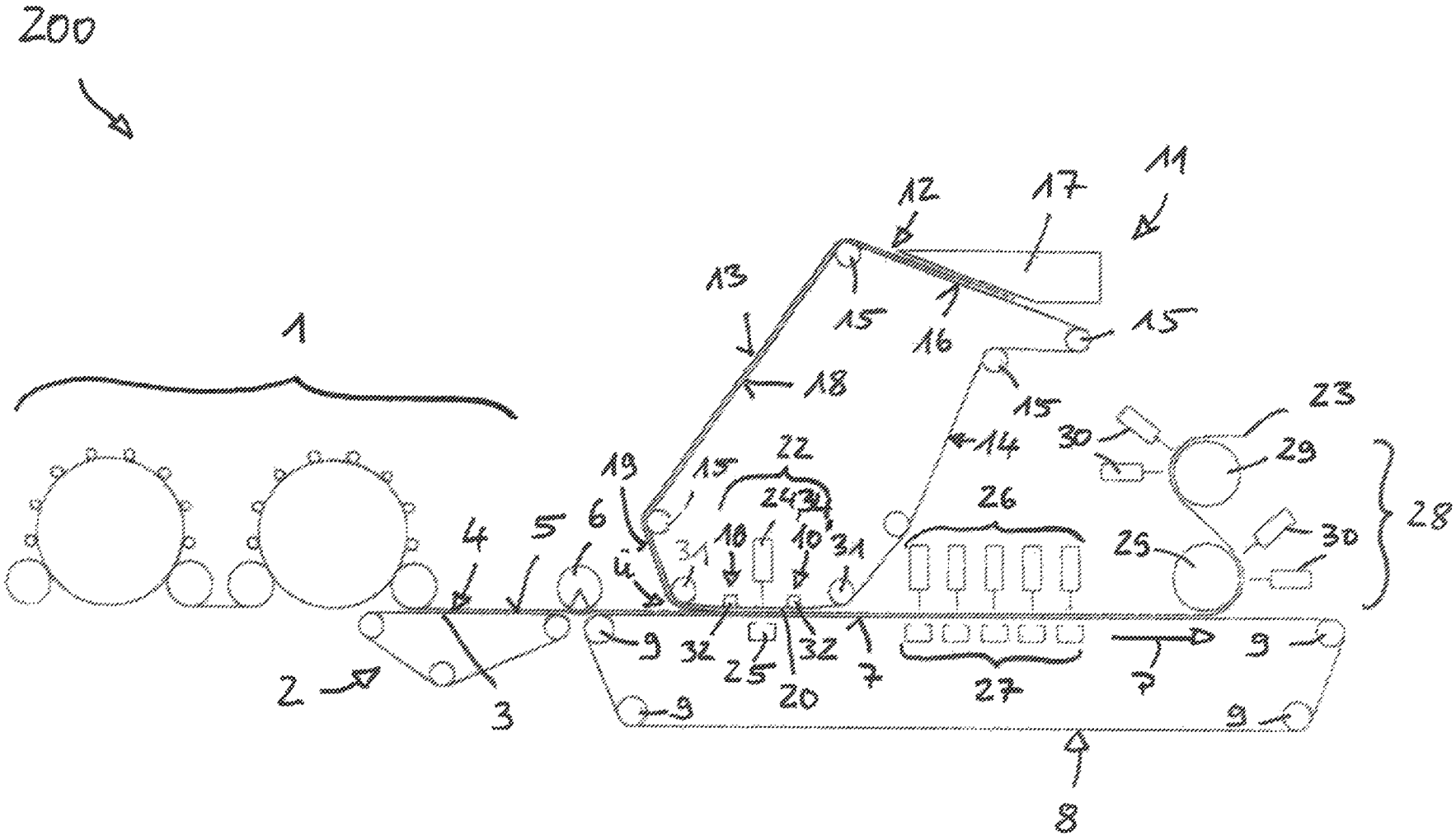
FIG. 2 is a second embodiment of the apparatus according to the present invention.

FIG. 2 shows a second embodiment of the apparatus according to the present invention (apparatus 200). Only the differences to apparatus 100 are described below. In order to avoid repetition, reference is otherwise made to the comments on apparatus 100, which also apply to apparatus 200.

Instead of the lower rollers 21, the apparatus 200 comprises lower rollers 31, which are at a greater distance from one another in the direction of production P and also from the upper run 7 of the first circulating belt 8 than the lower rollers 21. The lower rollers 31 are not part of the pre-bonding unit 22. In apparatus 200, this is formed by two pressure beams 32 arranged parallel to one another and perpendicular to the direction of production P, which are arranged in the apparatus 100 corresponding to the lower rollers 21 and replace their function in the pre-bonding unit 22.

The pressure beams 32 can be provided with plastic caps or with ceramic coatings in the regions in which they come into contact with the circulating belt 14 in order to reduce the friction with the second circulating belt 14.

Figure 3:
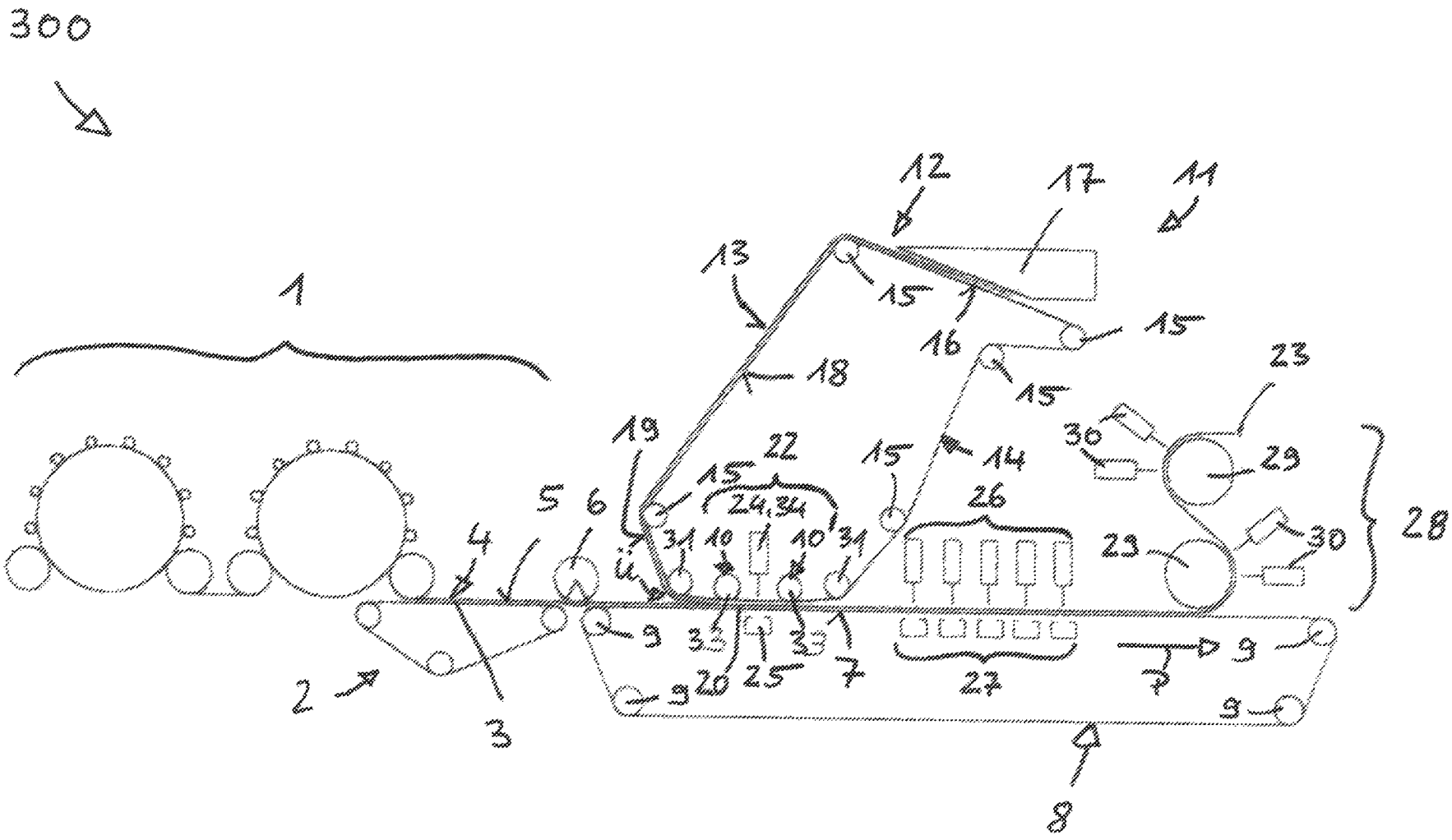
FIG. 3 is a third embodiment of the apparatus according to the present invention.
Figure 4:
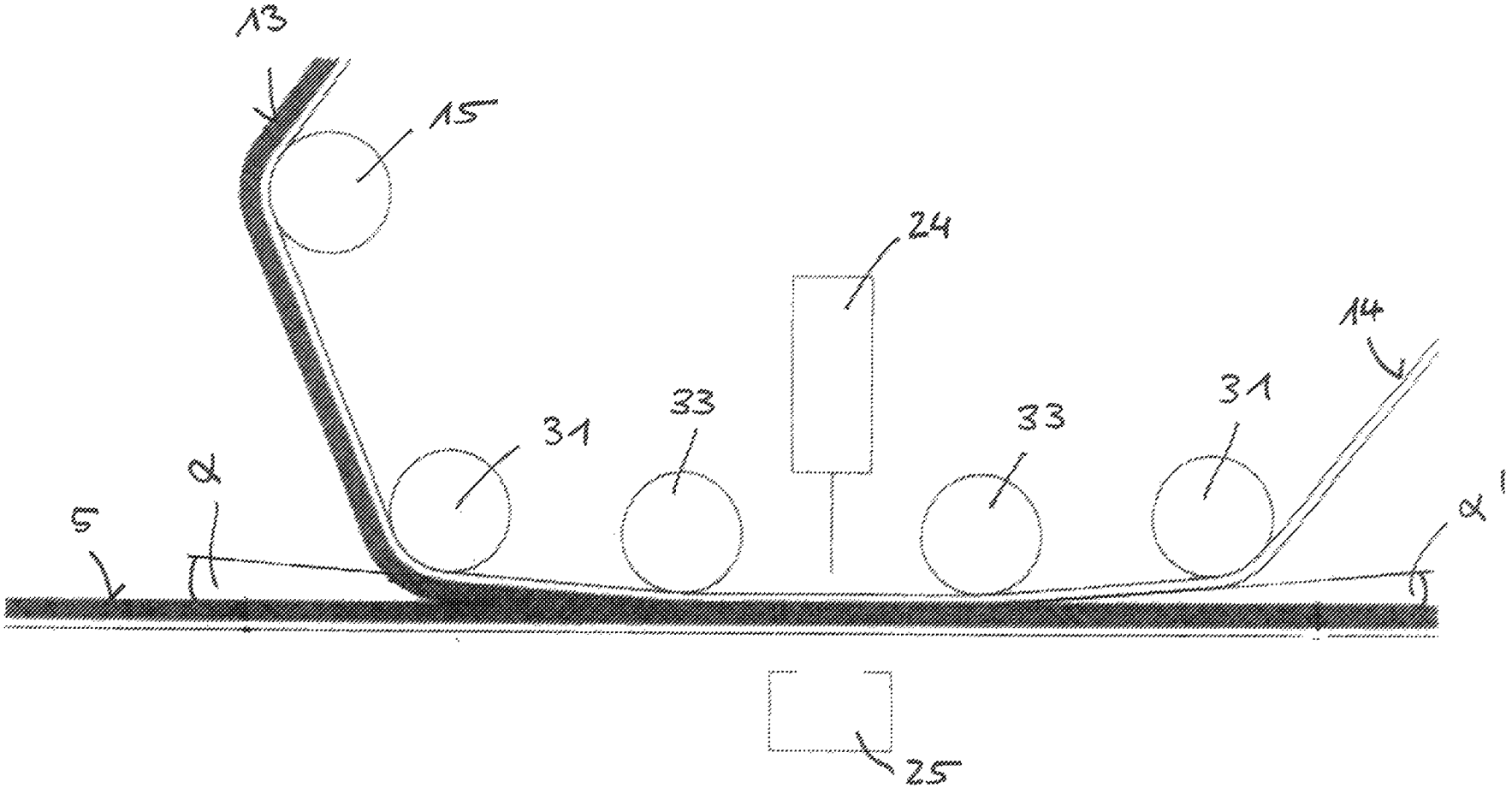
FIG. 4 is an enlarged view of detail IV in FIG. 3.

Since the lower rollers 31 are arranged at a greater distance from the upper run 7, the second circulating belt 14 runs between the lower rollers 31 and the respective pressure beam, forming angles $\alpha$, $\alpha'$, which can in particular be between 1° and 10°, as shown in FIG. 4 in connection with the third embodiment of the apparatus according to the present invention (apparatus 300) shown in FIG. 3.

Only the differences between apparatus 300 and apparatus 200 are described below. In this respect, in order to avoid repetition, reference is made to the explanations for apparatus 200 and also for apparatus 100.

In apparatus 300, the two pressure beams 32 are replaced by pressure rollers 33. This design is recommended in particular if the pre-bonding unit 22 is intended to apply higher pressure forces for compaction, since this can lead to an undesirable increase in the friction between the pressure beams 32 and the second circulating belt 14 in the apparatus 200.

Figure 5:
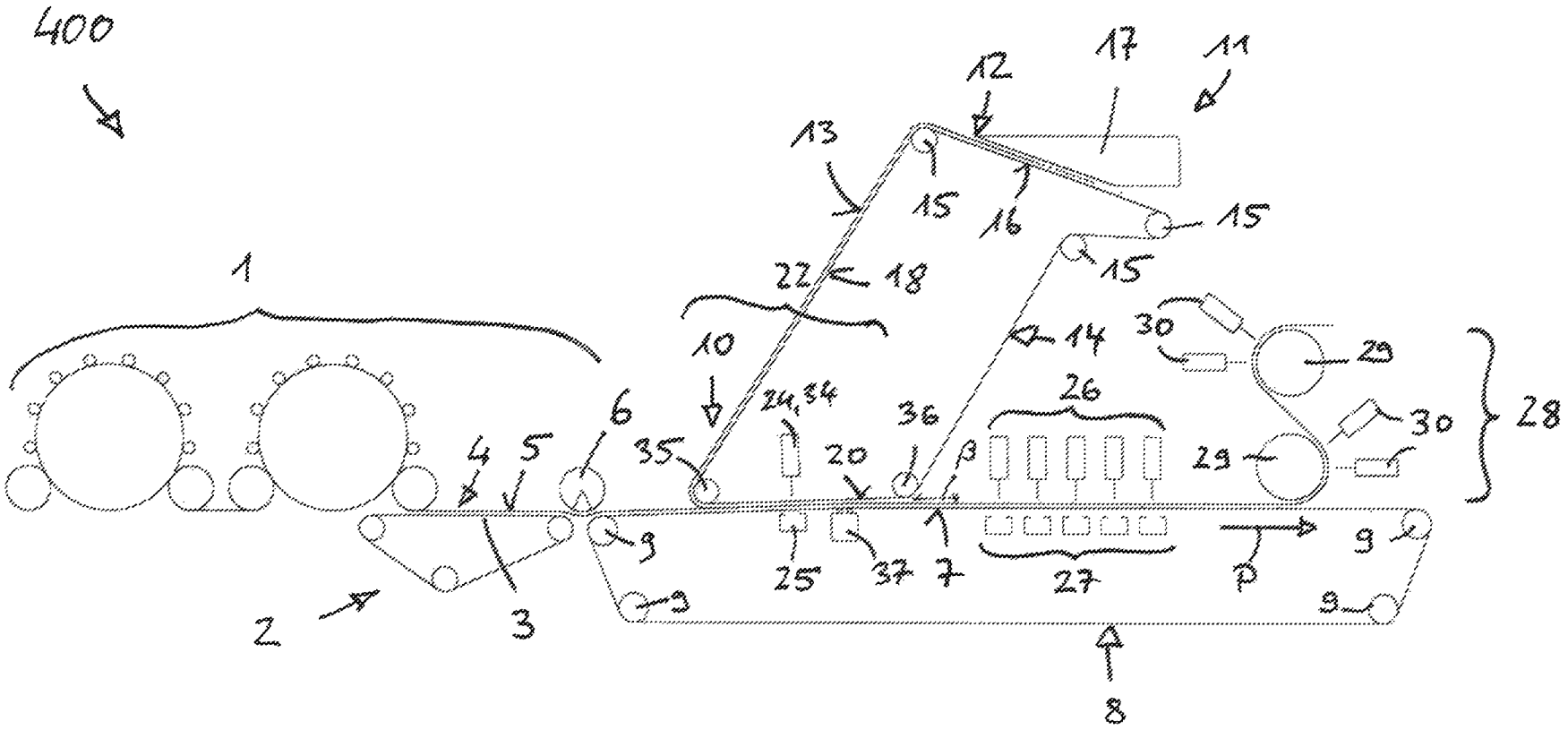
FIG. 5 is a fourth embodiment of the apparatus according to the present invention.

The fourth embodiment of the apparatus according to the present invention (apparatus 400) designated as a whole with 400 in FIG. 5 comprises, like the first embodiment of the apparatus 100 according to the present invention explained with reference to FIG. 1, a carding unit 1 with which a layer 5 of long fibers 4 can be produced. The carding unit 1 comprises a circulating deposit belt 2 having an upper run 3 on which the long fibers 4 can be deposited in the form of a layer 5 comprising the long fibers 4.

The apparatus 400 also includes a suction roller 6 with which the layer 5 can be transferred to an upper run 7 of a first circulating belt 8 circulating around rollers 9 in a clockwise direction. The upper run 7 moves in the direction of the arrow drawn in FIG. 1, which thus symbolizes the direction of production P.

The first circulating belt 8 is designed to be permeable to liquids and gases, for example, as a screen belt.

The apparatus 400 also includes a device 11 for providing a layer 13 comprising short fibers 12. For this purpose, the device 11 comprises a second circulating belt 14, which circulates counterclockwise around rollers 15.

The second circulating belt 14 is in turn designed to be permeable to liquids and gases, for example, as a screen belt. Due to the arrangement of the rollers 15, it forms a region 16 that ascends, as viewed in the direction of rotation, and in which the short fibers 12 are deposited from a headbox 17, for example, as an aqueous emulsion, to form the layer 13.

The layer 13 comprising short fibers 12 reaches a lower run 20 of the second circulating belt 14 via regions 18, 19 which slope downward in relation to the direction of circulation. The lower run 20 is formed between a first lower pressure roller 35 in the direction of production P and a second lower pressure roller 36 in the direction of production P.

In apparatus 400, the first lower pressure roller 35 forms a first compactor 10 and is part of a pre-bonding unit 22. When the apparatus 400 is in operation, the first lower pressure roller 35 is in a position relative to the upper run 7 of the first circulating belt 8 in which the distance between the lower run 20 of the second circulating belt 14 and the upper run 7 of the first circulating belt 8 is smaller than the sum of the thicknesses of layers 5 and 13.

A second compactor 10', which is also part of the pre-bonding unit 22, forms a suction chamber 37. It extends parallel to the first lower pressure roller 35, approximately over at least the width of the first circulating belt 8. The suction chamber 37 has upper, flat contact surfaces 38 against which the upper run 7 of the first circulating belt 8 rests with its underside. The suction chamber 37 has one or more intake ports 39 between the contact surfaces 38. The suction chamber 37 is arranged so that the first circulating belt 8 is pushed upwards by the suction chamber so that the upper run 7 runs parallel to the lower run 20 of the second circulating belt 14 between the first lower pressure roller 35 and the suction chamber 37. The pre-bonding unit 22 thus extends in the apparatus 400 between the first lower pressure roller 35 and the suction chamber 37.

Behind the suction chamber 37 as viewed in the direction of production P, the first circulating belt 8 drops by an angle β in relation to the lower run 20 of the second circulating belt 14. In the direction of production P, the distance between the first and second circulating belts 8, 14 thus increases behind the suction chamber before the second circulating belt 14 is deflected upwards around the second lower pressure roller 36.

Figure 6:
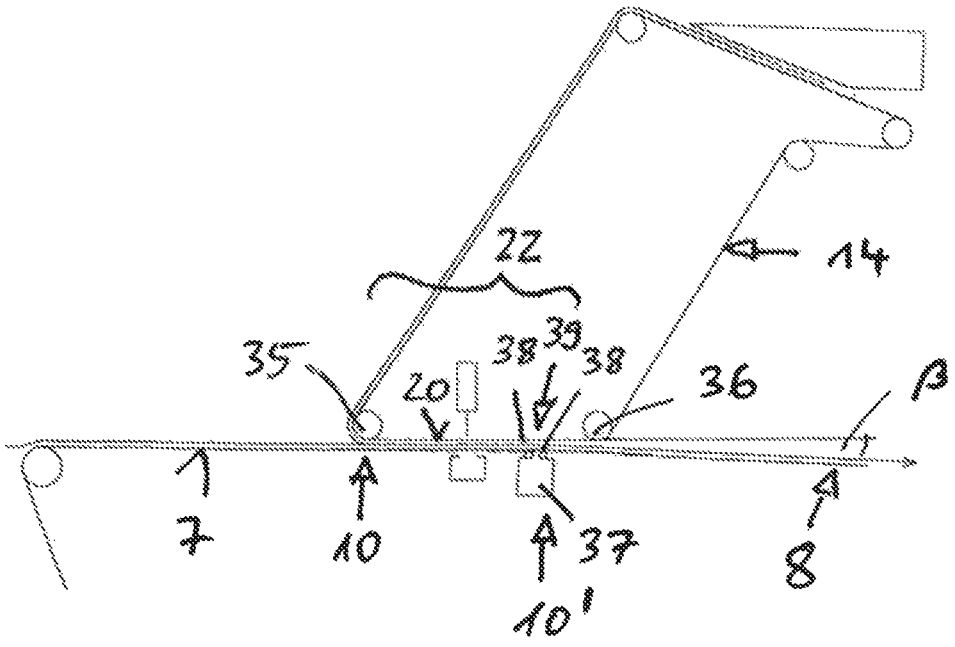
FIG. 6 is a partial view of a first pre-bonding unit (section VI in FIG. 5) of the fourth embodiment.

This first embodiment of the pre-bonding unit 22 is shown separately in FIG. 6.

The layer 13 is transferred to the layer 5 due to the arrangement of the rollers 15 and the first lower pressure roller 35 at a transfer point Ü, which is located in front of the lower pressure roller 35 as seen in the direction of production P. Since the distance between the upper run 7 and the lower run 20 between the compactors 10 is smaller than the sum of the thicknesses of the two layers 5 and 13, the two layers 5 and 13 experience a first areal compaction on the way to the formation of a non-woven web 23 when passing the area between the first lower pressure roller 35 and the suction chamber 37. The size of the area depends on the distance between the first lower pressure roller 35 and the suction chamber 37 in the direction of production P.

So that the desired compaction can take place, the first and second circulating belts 8, 14 must rotate at identical speeds, so that there is no friction during compaction, which could adversely affect the compaction process.

Tests have surprisingly shown that the risk of the layer 13 undesirably sticking to the second circulating belt 14 behind the pre-bonding unit 22 is reduced if the pre-bonding unit 22 is limited in the direction of production by two compactors 10, 10', of which the first compactor 10 acts on the second circulating belt 14 and the second compactor 10' acts on the first circulating belt 8 so that that the first circulating belt 8 undergoes a change in direction at an angle β of at least 1° when passing the second compactor 10'. In the case of the apparatus 400, the risk of sticking is further reduced in that the second compactor 10' is designed as a suction chamber 37, to which negative pressure is applied during operation of the apparatus 400, whereby an air flow is generated through the first circulating belt 8 which supports a detachment of the layer 13 from the second circulating belt 14.

So that the two layers 5 and 13 have sufficient strength after leaving the region between the upper run 7 and the lower run 20 for further processing steps to form the non-woven web 23, the pre-bonding unit 22 comprises a nozzle bar 24 arranged in the direction of production P between the first lower pressure roller 35 and the second lower pressure roller 36 and inside the second circulating belt 14, which nozzle bar 24 forms a bonding device 34, and a collecting device 25 arranged in the direction of production P at a corresponding point inside the first circulating belt 8, which can be a suction box subjected to negative pressure. On its side facing the lower run 20, the nozzle bar 24 comprises a plurality of nozzles, from which jets of water are emitted under pressure during operation of the apparatus 100 so as to bond the two layers 5 and 13 through the lower run 20 of the second circulating belt 14 by twirling the fibers. The collecting device 25 is used to collect at least part of the water discharged from the nozzle bar 24, which can then be returned to the production process, possibly after treatment.

For further bonding and compaction, a plurality of nozzle bars 26 and collecting devices 27 are provided outside of the second circulating belt in order to additionally bond the layers 5 and 13 from above.

A further bonding device 28 is provided downstream in the direction of production P. The bonding device 28 comprises two bonding drums 29 which are circulated by the layers 5 and 13 during operation so that each of the two layers 5 and 13 is in contact with one of the two bonding drums 29 over an angular range of approximately 120°. Two additional nozzle beams 30 are provided for each bonding drum 29 and act in a region in which the layers 5 and 13 are in contact with the bonding drum 29.

The bonding drums 29 each have a gas- and liquid-permeable lateral surface, so that at least part of the water discharged from the nozzle beam 30 during operation can be sucked off by the bonding drums 29 and also, possibly after treatment, can be returned to the production process. The bonding device 28 is used for the further bonding of the two layers 5 and 13 to form the non-woven web 23 which, after passing through the bonding device 28, can be fed to further processing steps not described here.

Figure 7:
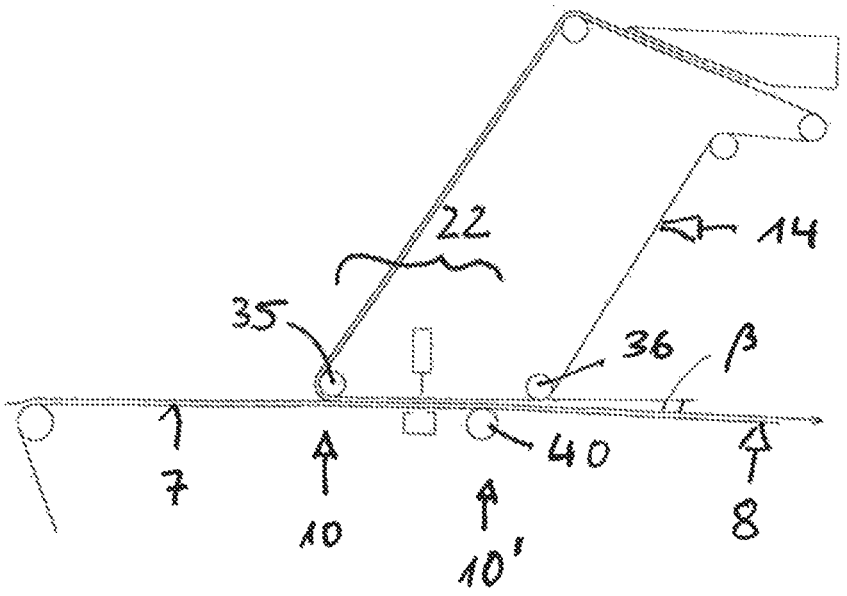
FIG. 7 is a partial view corresponding to FIG. 6 of a second pre-bonding unit.

A second embodiment of a pre-bonding unit 22 of the fourth embodiment of the apparatus 400 is shown in FIG. 7. In order to avoid repetition, only the differences from the first embodiment of the pre-bonding unit will be described. Like reference signs thereby denote like components.

In the second embodiment of the pre-bonding unit 22, a pressure roller 40 is provided instead of the suction chamber 37, which pressure roller 40 is aligned parallel to the first lower roller, and extends over the entire width of the first circulating belt 8 and presses against its upper run 7 from below, analogous to the suction chamber 37 in the first embodiment of the pre-bonding unit 22.

In this second embodiment, a detachment of the layer 13 from the second circulating belt 14 in the direction of production behind the pressure roller 40 is supported solely by the change in direction that the first circulating belt 8 experiences when passing the pressure roller 40. If necessary, the roller 20 can be designed as a suction roller, which can be subjected to a negative pressure in order to generate an air flow through the first circulating belt 8 directed toward the surface of the suction roller.

Figure 8:
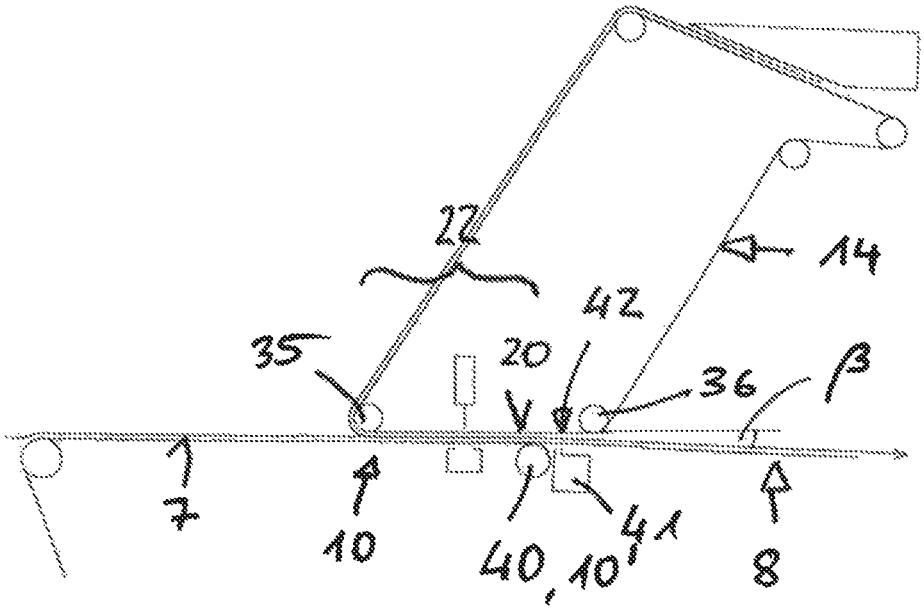
FIG. 8 is a partial view corresponding to FIG. 6 of a third pre-bonding unit.

A third embodiment of a pre-bonding unit 22 of the fourth embodiment of the apparatus 400 is shown in FIG. 8. In order to avoid repetition, only the differences from the second embodiment of the pre-bonding unit will be described. Like reference signs thereby denote like components.

In the third embodiment of the pre-bonding unit 22, a pressure roller 40 is in turn provided, which is aligned parallel to the first lower pressure roller 35, and extends over the entire width of the first circulating belt 8 and presses against its upper run 7 from below. A suction chamber 41 is provided immediately behind this pressure roller 40 in the direction of production, which does not bear against the upper run 7 of the first circulating belt 8 from below, but generates an air flow directed from top to bottom through the first circulating belt 8 by applying negative pressure and thus supports the detachment of the layer 13 from the upper circulating belt 14. For this purpose, the suction chamber 41 has an intake port 42 which is adjacent to the pressure roller 40 as viewed in the direction of production.

In this third embodiment, detachment of the layer 13 from the second circulating belt 14 in the direction of production behind the pressure roller 40 is not caused solely by the change in direction that the first circulating belt 8 experiences when passing the pressure roller 40, but is supported by the suction chamber 41. Since the first circulating belt 8 is not supported by the suction chamber 41 but by the rotating pressure roller 40, and the first circulating belt only rests against the suction chamber in such a way that the air flow caused by the suction chamber takes place through the first circulating belt 8 and the friction acting on the first circulating belt compared to the first embodiment of the pre-bonding unit 22 is reduced.

Figure 9:
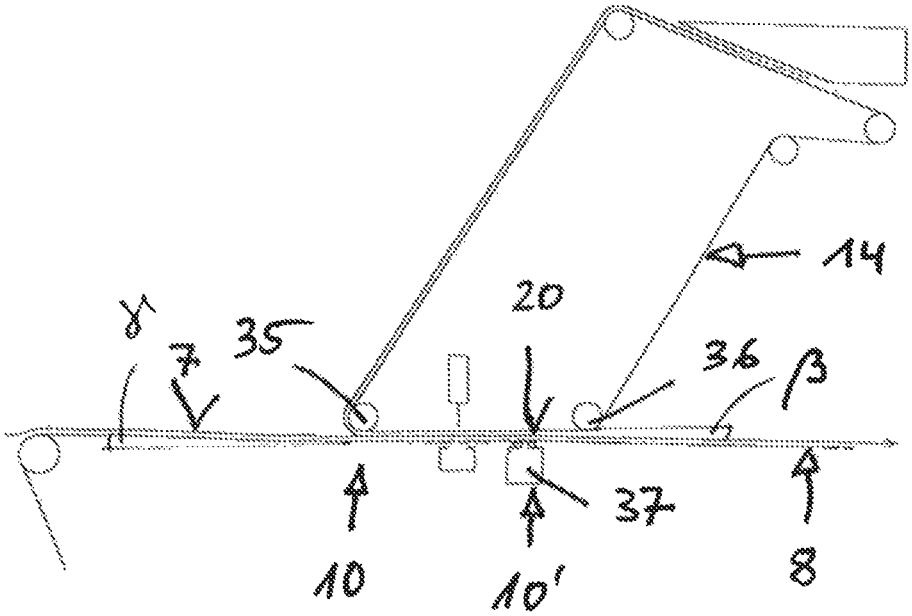
FIG. 9 is a partial view corresponding to FIG. 6 of the first pre-bonding unit with a modified guidance of the upper run of the first circulating belt.

FIG. 9 shows the first embodiment of a pre-bonding unit 22 of the fourth embodiment of the apparatus 400 with a modified guidance of the upper run 7 of the first circulating belt. In order to avoid repetition, only the differences from the guidance shown in FIG. 6 will be described. Like reference signs thereby denote like components.

When the upper run 7 of the first circulating belt 8 is guided as shown in FIG. 6, the first circulating belt 8 does not change direction when it passes the first lower pressure roller 35. In order to increase the compacting effect of the first lower pressure roller 35, the first circulating belt 8 is guided in the guidance shown in FIG. 9, however, so that the upper run 7 of the first circulating belt 8 is pressed in the region of the first lower pressure roller 35 against the second circulating belt 14 and thus experiences a change in direction by a small angle $\lambda$ by the action of the pressure roller 35.

The three above-described embodiments of the apparatus according to the present invention show a carding unit 1 for providing the layer 5 comprising long fibers 4. It goes without saying that not only a carding unit 1 can be used to provide such a layer, but also other devices with which a layer 5 comprising long fibers 4 can be produced inline. The layer 5 can also be generated separately, i.e., offline, and provided, for example, wound up into a roll. In such a case an unwinding station is, for example, provided instead of the carding unit 1.

The present invention is not limited to embodiments described herein; reference should be had to the appended claims.

LIST OF REFERENCE SIGNS

100 Apparatus
200 Apparatus
300 Apparatus
400 Apparatus
1 Carding unit
2 Deposit belt
3 Upper run
4 Long fibers
5 Layer
6 Suction roller
7 Upper run
8 First circulating belt
9 Rollers
10, Compactor/First compactor
10' Compactor/Second compactor
11 Device
12 Short fibers
13 Layer
14 Second circulating belt
15 Rollers
16 Region
17 Headbox
18 Region
19 Region
20 Lower run
21, 21' Lower rollers
22 Pre-bonding unit
23 Non-woven web
24 Nozzle bar
25 Collection device
26 Nozzle bar

27 Collecting devices
28 Bonding device
29 Bonding drums
30 Nozzle beam
31 Lower rollers
32 Pressure bar
33 Pressure rollers
34 Bonding device
35 First lower pressure roller
36 Second lower pressure roller
37 Suction chamber
38 Contact surfaces
39 Intake port
40 Pressure roller
41 Suction chamber
42 Intake port
α Angle/Inlet angle
α' Angle/Outlet angle
A Distance
β Angle
D Diameter
λ Small angle
P Direction of production
Ü Transition point

What is claimed is:

1. An apparatus for bonding a first layer comprising short fibers with a second layer comprising long fibers to form a non-woven web, the apparatus comprising:

a first circulating belt on which the second layer comprising the long fibers is depositable and displacable in a direction of production;

a second circulating belt via which the first layer comprising the short fibers is transferable at a transition point to the second layer comprising the long fibers;

a pre-bonding unit which is arranged directly behind the transition point in the direction of production, the pre-bonding unit comprising a first compactor and a second compactor which are arranged spaced apart from one another in the direction of production, the first compactor and the second compactor each being configured to act in one region on the first circulating belt or in one region of the second circulating belt; and a bonding device which is arranged between the first compactor and the second compactor in the direction of production, the bonding device being configured to bond together the first layer with the second layer by twirling the long fibers and the short fibers, wherein, the first compactor, the second compactor and the bonding device are integrated into the apparatus so as to always be in an operating state together when the first layer comprising the short fibers is transferred using the second circulating belt.

2. The apparatus as recited in claim 1, wherein the first compactor and the second compactor each comprise a pressure roller.

3. The apparatus as recited in claim 1, wherein the first compactor and the second compactor each comprise a pressure bar.

4. The apparatus as recited in claim 1, wherein the first compactor and the second compactor are further arranged so that, in the operating state, the first compactor and the second compactor bear against the first circulating belt or against the second circulating belt.

5. The apparatus as recited in claim 1, further comprising:

at least one lower roller, wherein, when viewed in the direction of production, at least one of, the at least one lower roller is arranged in front of the pre-bonding unit so as to be circulated by the second circulating belt, and the at least one lower roller is arranged behind the pre-bonding unit so as to be circulated by the second circulating belt.

6. The apparatus as recited in claim 5, wherein, two of the at least one lower roller is provided, and the two lower rollers are further arranged so that the second circulating belt between the two lower rollers and the respectively adjacent the first compactor/second compactor has an inlet angle to the first circulating belt of between 1° and 10° and an outlet angle of greater than 1°.

7. The apparatus as recited in claim 1, wherein, the first circulating belt comprises an upper run, the second circulating belt comprises a lower run, and the first compactor, as seen in the direction of production from above against the lower run of the second circulating belt, and the second compactor, as seen in the direction of production from below against the upper run of the first circulating belt, act so that the first circulating belt undergoes a change in direction by an angle when passing the second compactor.

8. The apparatus as recited in claim 7, wherein the first compactor further comprises a first lower pressure roller.

9. The apparatus as recited in claim 7, wherein the second compactor further comprises a suction chamber.

10. The apparatus as recited in claim 9, wherein the suction chamber comprises at least one contact surface for the first circulating belt.

11. The apparatus as recited in claim 10, wherein the suction chamber further comprises an intake port.

12. The apparatus as recited in claim 7, wherein the second compactor further comprises a pressure roller.

13. The apparatus as recited in claim 12, further comprising:

a suction chamber which is arranged directly behind the pressure roller in the direction of production.

14. The apparatus as recited in claim 1, wherein the bonding unit comprises a nozzle bar.

15. The apparatus as recited in claim 14, wherein the nozzle bar is arranged inside the second circulating belt.

* * * * *